US005396938A

United States Patent [19]

Cannaday

[11] Patent Number: 5,396,938

[45] Date of Patent: Mar. 14, 1995

[54] APPARATUS AND METHOD FOR PRODUCING SURFACED LUMBER

[75] Inventor: Ray L. Cannaday, Tigard, Oreg.

[73] Assignee: Boring Machine Works, Inc., Boring, Oreg.

[21] Appl. No.: 169,142

[22] Filed: Dec. 17, 1993

[51] Int. Cl.[6] ..... B27B 1/00; B27C 9/00

[52] U.S. Cl. ..... 144/357; 83/368; 83/425.4; 144/3 R; 144/39; 144/116; 144/369; 144/378

[58] Field of Search ..... 83/368, 404, 422, 425.3, 83/425.4; 144/3 R, 39, 41, 356, 357, 367, 369, 373, 374, 375, 376, 378

[56] References Cited

U.S. PATENT DOCUMENTS

| | | | |
|---|---|---|---|
| 1,825,041 | 9/1931 | Babare | 144/39 |
| 2,649,872 | 8/1953 | Miller | 144/39 |
| 2,859,780 | 11/1958 | Carlson | 144/116 |
| 3,323,565 | 6/1967 | Pepse | 144/39 |
| 3,960,041 | 6/1976 | Warren et al. | 83/361 |
| 4,335,767 | 6/1982 | Reuter | 144/370 |
| 4,599,929 | 7/1986 | Dutina | 144/41 |
| 4,879,659 | 11/1989 | Bowlin et al. | 144/357 |
| 4,947,909 | 8/1990 | Stroud | 144/39 |
| 5,201,351 | 4/1993 | Hurdle, Jr. | 144/39 |

*Primary Examiner*—W. Donald Bray
*Attorney, Agent, or Firm*—Klarquist, Sparkman, Campbell, Leigh & Whinston

[57] ABSTRACT

Apparatus and method for, in one continuous operation, receiving a slab sawn from a log, sensing the thickness of the slab and setting the apparatus to plane its upper and lower surfaces to produce a desired thickness slab which then is sawn into boards of desired width. The apparatus includes upper and lower planer heads, the upper of which is mounted on adjustable setworks for raising and lowering. At the infeed end of the apparatus a sensor determines the thickness of an entering slab and through control mechanism adjusts the space between the planer heads to plane the slab to a desired common board thickness which is the maximum available from the slab size. A bank of smooth cutting saws downstream from the planer heads saws the slab into smooth-sided boards.

20 Claims, 3 Drawing Sheets

APPARATUS AND METHOD FOR PRODUCING SURFACED LUMBER

BACKGROUND AND SUMMARY OF THE INVENTION

This invention relates to apparatus and method for receiving a slab of wood sawn from a log and in one continuous operation producing boards having four substantially smooth surfaced sides.

Sawmill operations, as commonly practiced, have substantial inefficiencies in the apparatus and method in which they produce smooth- surfaced lumber. Although various apparatus and methods have been attempted in the past, the usual prior method is as follows.

A log initially is sawn lengthwise into a plurality of slabs having a variety of thicknesses. These thicknesses are determined by the contour and size of the log to obtain maximum yield from the log. These slabs are sawn to thicknesses somewhat in excess of that which is necessary for boards of standard thicknesses so that they can be planed to a desired standard thickness.

After the slabs are sawn from the log in a variety of thicknesses they then generally are separated into stacks according to thickness. A stack of slabs of all one thickness then is taken to gang saw apparatus which saws the slabs into individual boards of selected width.

Since the boards sawn from a slab may be of different widths, although they are all the same thickness, these then must be sorted as to width and stacked in their appropriate size ranges to provide separate stacks wherein each stack will include only boards of common width and thickness.

Then, each individual stack of boards which has a common thickness and width is taken to a combination planer/edger machine where the boards are fed individually therethrough to produce planed upper and lower surfaces and planed, or edged, side surfaces. Such planer/edger machines generally have had to be manually preset for each individual stack of boards having a specific thickness and width. The boards of all one thickness and width had to be fed through the planer/edger. Then when another stack with a different width-thickness configuration arrived the planer/edger had to be reset. It will be recognized that this is a time-consuming operation requiring a number of stacking, moving, sorting and equipment resetting steps.

Others have attempted to improve the efficiency of such operation by development of various apparatus, but such appears to have been unsuccessful, because the industry continues to operate generally as set out above, with the multiple cutting, sorting, stacking, and planing steps.

An object of the present invention is to overcome such inefficiencies of prior operations and produce apparatus and a method that are operable to receive slabs of various thicknesses and widths, and in one continuous series of steps, without intermediate sorting and stacking, produce a plurality of boards with all four sides smooth surfaced.

A further object of the present invention is to provide novel apparatus which senses the thickness of a slab sawn from a log introduced to a conveyor path extending through the apparatus, automatically sets a preferred vertical distance between upper and lower planing heads to remove material from the upper and lower surfaces of the slab as it is carried therethrough to produce a slab having smooth upper and lower surfaces with a thickness of a common size of boards to be produced from this slab, and downstream from the planing head has a series of upright laterally spaced saws operable to produce smooth cuts in the slab to produce boards having substantially smooth surfaces on all four sides.

Yet another object of the present invention is to provide such apparatus which includes hold-down mechanism adjacent the planing heads for controlling the positioning of a slab as it is moved along the conveyor through the planer head to produce accurate planing of the upper and lower surfaces.

Another object of the present invention is to provide a novel method for separating a slab sawn from a log into a plurality of boards having smooth surfaced sides which does not require multiple sorting, stacking and movement steps between various stages in the operation.

A further object of the invention is to provide on a common frame apparatus for sensing the thickness of a slab sawn from a log, varying the vertical distance between a pair of upper and lower planer heads to remove material from the upper and lower surfaces of the slab as it is carried along a path therebetween to produce smooth upper and lower surfaces, and a plurality of substantially upright saws spaced laterally at selected distances from each other downstream from the planer heads to saw the slab into boards of selected width having substantially smooth sides.

More specifically, an object of the invention is to provide a novel method for separating a slab sawn from a log into a plurality of boards having smooth surfaced sides, including the steps of moving a slab substantially horizontally along a path, sensing the thickness of the slab, providing upper and lower planing heads adjacent the top and bottom of the path, the lower head being preset to remove a minor portion of the underside of the slab to provide a finished surface thereon and the upper head being shiftable vertically relative to the lower head, positioning the upper head a selected vertical distance from the lower head in relation to the sensed thickness of the slab, moving the slab through the space between the planer heads to plane the slab to a selected thickness with smooth upper and lower surfaces, providing multiple upright saws in the path of the slab downstream from the planer heads spaced apart laterally desired distances for producing boards of select widths, and moving the slab through the saws to produce boards with smooth sides.

These and other objects and advantages will become more fully apparent as the following description is read in conjunction with the following drawings.

DESCRIPTION OF PREFERRED EMBODIMENT

Figure 1:
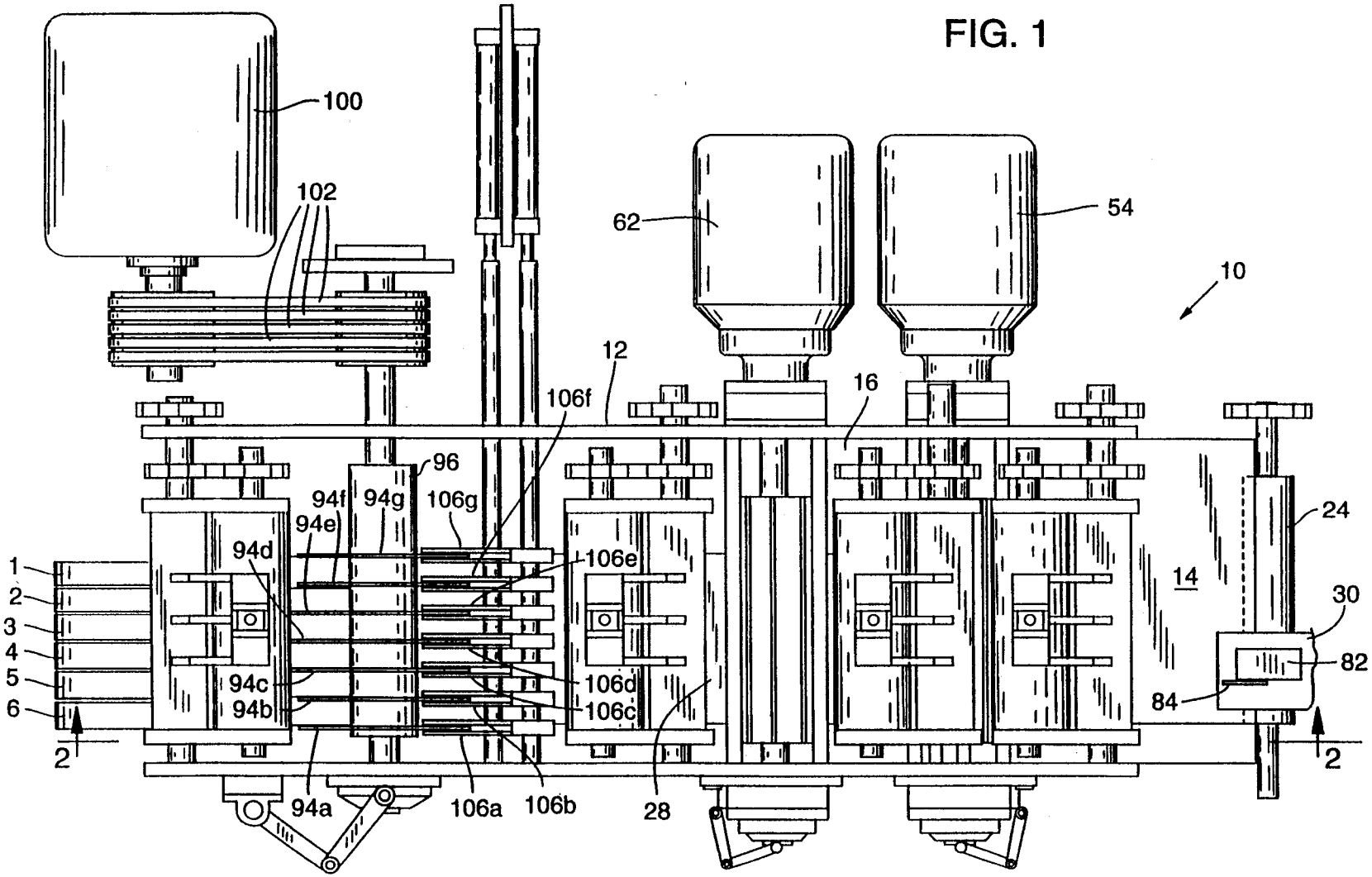
FIG. 1 is a top plan view of apparatus constructed according to an embodiment of the invention.
Figure 2:
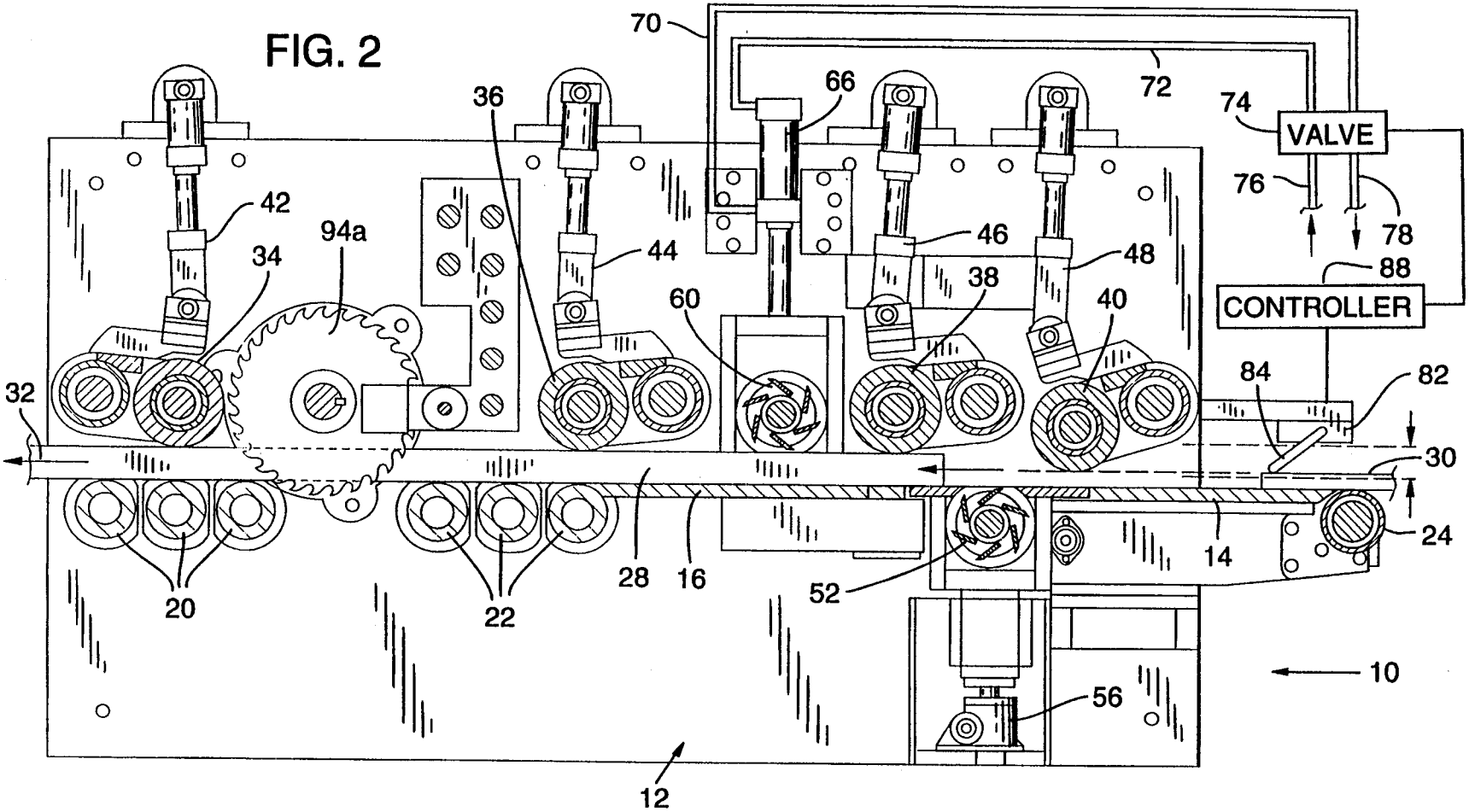
FIG. 2 is a side elevation view taken generally along the line 2—2 in FIG. 1.

Referring to the drawings, and first, more specifically to FIGS. 1 and 2, at 10 as indicated generally apparatus according to the invention. It includes an elongate frame indicated generally at 12 on which the operating elements to be described herein are mounted.

Secured to the frame and extending laterally thereof are plates 14, 16 and rollers 20, 22, 24, all of which have their upper surfaces aligned in a substantially common horizontal plane to define a conveyor for supporting and carrying slabs of lumber sawn from logs along a path through the apparatus, as will be described in greater detail below.

A first slab 28 illustrated in FIGS. 1 and 2 is supported on plates 14, 16 and rollers 20, 22 for movement along the substantially horizontal path in the direction of arrow 32 through the apparatus. A second slab 30, which is thinner than slab 28, is indicated at the right end of FIGS. 1 and 2 entering the apparatus and being supported on plate 14 and roller 24.

A plurality of hold down rollers noted generally at 34, 36, 38, 40 are suspended on hydraulic cylinders 42, 44, 46, 48, respectively. These rollers may be raised or lowered by the hydraulic cylinders as necessary to press against the tops of slabs carried through the apparatus to hold the slabs in tight contact with the underlying plates and rollers. Various ones of the underlying and hold down rollers are powered for rotation to drive slabs in a downstream direction through the apparatus along a path, the underside of the path being defined by the upper sides of plates 14, 16 and the upper surfaces of rollers 20, 22, 24.

An elongate, multi-knife, rotating lower planer head 52 extends laterally of the frame 12 between the upstream end of plate 16 and the downstream end of plate 14. A motor 54 (FIG. 1) is operatively connected to planer head 54 for rotating the head in a clockwise direction as illustrated in FIG. 2.

The lower planing head 52 is supported on a screw-jack 56. The jack may be operated to position the planer head so that its rotating knives project a short distance above the plane of the tops of plates 14, 16 thus to remove a minor portion of the underside of a slab carried therepast to produce a smooth lower surface on the slab. Once the lower planing head is set in position, it seldom needs to be raised or lowered.

Positioned downstream on frame 12 from lower planing head 52 is an elongate, multi-knife, rotating upper planing head 60. Head 60 extends transversely of the frame and overlies the path along which slabs are conveyed. A motor 62 is operatively connected to planer head 60 to provide rotation in a counter clockwise direction as illustrated in FIG. 2.

Head 60 is supported for vertical shifting by an overlying setworks including a plurality of hydraulic cylinders, such as that indicated generally at 66. The setworks is operable to raise and lower planer head 60 to vary the vertical spacing between lower head 52 and upper head 60. The upper and lower ends of cylinder 66 are connected through pressure fluid lines 70, 72 to a valve 74. The valve, in turn, is connected to a source of pressurized fluid through inlet line 76 and exhaust line 78. Shifting of the valve is operable either to raise or lower the upper head 60, or to hold it in a selected position.

Adjacent the upstream end of the apparatus is a slab thickness sensing device, or switch, indicated generally at 82. It includes a swing arm 84 which rides on the upper surface of a slab introduced to the apparatus to sense the thickness of such slab. The thickness thus sensed is transmitted to a controller 88 which, through a predetermined program actuates valve 74 to operate setworks cylinder 66.

Explaining further, as illustrated in FIG. 2, upper head 60 is positioned to plane the upper surface of slab 28 whereby the slab is shaved to a selected thickness that produces a slab of maximum common lumber thickness while assuring a smooth upper surface for the slab.

It will be noted that slab 30 being introduced into the apparatus at the upstream end is substantially thinner than slab 28. This is detected by sensor 82 and a signal is provided to controller 88 indicating the thickness of slab 30. After prior slab 28 passes beyond upper planing head 60, controller 88 actuates valve 74 to lower planer head 60 to a vertical spacing from head 52 to plane slab 30 to a selected thickness that is the maximum common lumber thickness that can be produced from slab 30 while assuring planed smooth upper and lower surfaces.

Although not shown in the drawings similar valving and control mechanism is associated with cylinders 42, 44, 46, 48 to properly position them above the conveyor path to provide desired slab hold-down operation.

Positioned downstream from the planing heads are a plurality of upright circular saw blades **94*a*, 94*b*, 94*c*, 94*d*, 94*e*, 94*f*, 94*g* mounted on a common shaft 96. Shaft 96 is rotated by a motor 100 through a plurality of belts 102**.

The saw blades are of a thin kerf carbide tip style which run very true to produce smooth sides on boards cut thereby. In the preferred embodiment, the blades are of a type to cut a kerf-width of 0.080 to 0.125 inch. The blades may be mounted for shifting independently of each other transversely of the apparatus and axially of shaft 96 to provide selected spacing therebetween to produce boards of selected width. Associated with each blade is a blade trueing and shifting device **106*a*, 106*b*, 106*c*, 106*d*, 106*e*, 106*f*, 106*g***, respectively. Devices are known in the industry for shifting blades longitudinally of a shaft and maintaining substantially true running of the blades. They include a pair of plates on opposite sides of each blade with babbitt metal to engage the sides of the blade.

Figure 3:
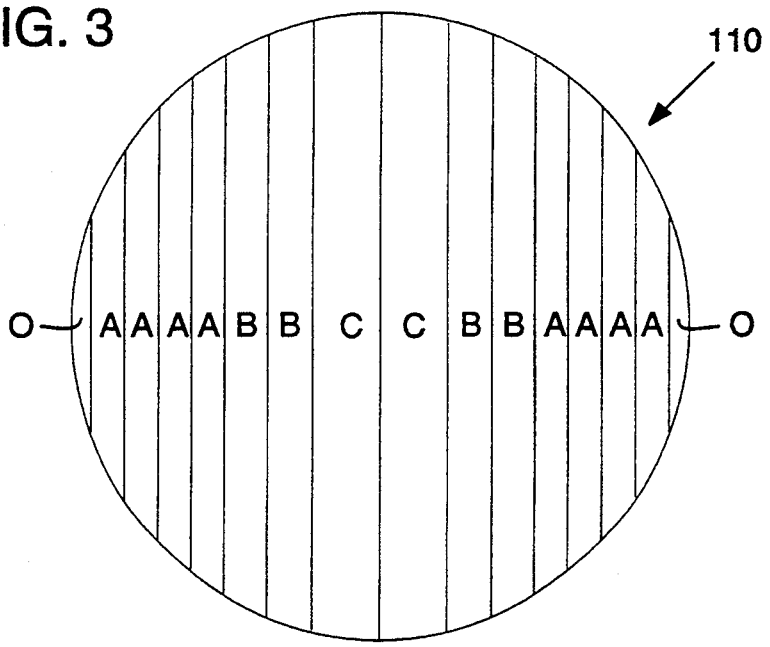
FIG. 3 is an end elevation view of a log illustrating a variety of slabs to be sawn therefrom.
Figure 4:
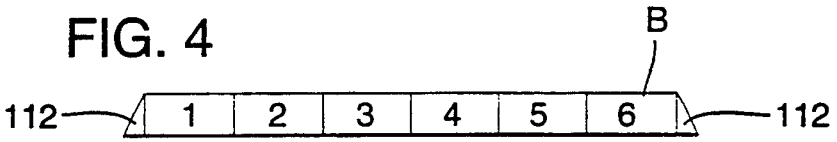
FIG. 4 is an end elevation view of a slab sawn from the log in FIG. 3.

Describing operation of the apparatus, and referring first to FIG. 3, a log 110 would be sawn longitudinally by a known headrig saw into a number of slabs with varying thicknesses as noted 0, A, B, C. The side segments indicated as "O" generally are unusable because of their configuration. Slabs A are the thinnest of those sawn from the log, slabs B are thicker, and slabs C are the thickest. A slab B is illustrated in FIG. 4 laid substantially horizontally. From this slab it is noted that six boards numbered 1, 2, 3, 4, 5, and 6 are to be obtained. It should be recognized that a slab sawn from log 110 is somewhat thicker than the boards intended to be produced therefrom, so that the upper and lower surfaces of the slab may be planed to smooth usable surfaces. It will be recognized also that small triangular sections 112 are produced at outer edges of slab B which will be unusable for producing boards.

The slab is introduced to the upstream end of apparatus 10, at the right end of FIGS. 1 and 2, and is moved substantially horizontally in a downstream direction, to the left in the figures. Finger 84 of sensing device 82 rests atop the slab as it is introduced to determine its thickness and sends a signal to controller 88 indicating to valve 74 whether to raise, lower, or leave upper planer head 60 in its present position relative to lower planer head 52. The vertical spacing between heads 52, 60 will be established such as to produce a slab thickness that is the maximum for boards obtainable from the slab.

Figure 5:
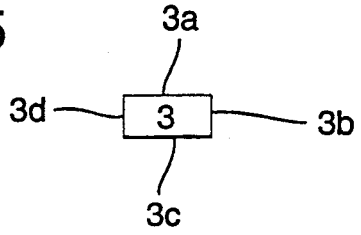
FIG. 5 is an end elevation view of a board sawn from the slab illustrated in FIG. 4.

As the slab is moved downstream through the apparatus it is supported in a substantially horizontal path by plates 14, 16 and rollers 20, 22, 24. Further, it is held down against these plates and rollers by rollers 34, 36, 38, 40 and the operations of their supporting cylinders. As the slab moves over planer head 52, its underside is planed to a smooth surface. As it moves under planer head 60 its upper surface is planed smooth. Continuation of movement along the path brings the slab into contact with saw blades 94*a*, 94*b*, 94*c*, 94*d*, 94*e*, 94*f*, 94*g* which saw the slab into individual boards 1, 2, 3, 4, 5, 6. The saw blades run substantially true and cut smoothly. All four sides of a board 3, such as that indicated at 3*a*, 3*b*, 3*c*, 3*d* in FIG. 5 are substantially smooth surfaces. There is thus no further operation needed outside the apparatus described for producing, from a slab, multiple boards having all four sides surfaced smooth.

The operation of the apparatus is such that a slab is moved therethrough at a speed of approximately 130 to 200 feet per minute. This is approximately one-half the speed of normal sawmill operations. Such slower movement through the planer heads and saw blades provides for much smoother surfaces being produced on all sides, while allowing sizing, planing and sawing to be accomplished in one efficient, continuous operation.

It has been found that by having the combined apparatus producing the method described above such slower operational speeds can be used and still substantially improve the efficiency of the overall production of lumber. This occurs by eliminating the many steps required in prior apparatus for sorting, stacking, and running individual pieces through a variety of operations as has occurred commonly in prior commercial practices.

While a preferred embodiment of the invention has been described herein, it should be apparent to those skilled in the art that variations and modifications are possible without departing from the spirit of the invention.

I claim:

1. Lumber forming apparatus comprising a conveyor for carrying a slab sawn from a log substantially horizontally along a path;

a lower rotating planer head positioned adjacent the underside of said path operable to remove a portion from the underside of such slab and provide a finished surface thereon;

an upper rotating planer head positioned above said path operable to remove a portion from the upper surface of such slab and provide a finished surface thereon;

setworks connected to and supporting said upper planer head operable to vary the vertical distance between said upper and lower planing heads;

a slab thickness sensor positioned upstream in said path from said upper head operable to sense the thickness of a slab entering said path as it is moved toward said upper planer head;

a controller operatively interconnecting said thickness sensor and setworks operable to move said upper head to a preselected vertical distance from said lower head in relation to the thickness of a slab directed toward said upper head to produce a slab of preselected thickness; and a plurality of upright saws positioned downstream from said upper head to saw said slab into preselected board widths.

2. The apparatus of claim 1, wherein said lower planer head is preset in a selected position relative to the path of said conveyor.

3. The apparatus of claim 2, wherein said setworks is hydraulically actuated and said apparatus comprises a valve operable to control the flow of fluid under pressure to said setworks to position said upper planer head.

4. The apparatus of claim 3, wherein said controller is operable to produce shifting of said upper planer head to produce a slab of preselected finished thickness in relation to the thickness of the slab as sensed on entering the conveyor path upstream from said upper planer head.

5. The apparatus of claim 1, wherein said saws are mounted for shifting laterally within the conveyor path, and said apparatus comprises shifting mechanism for moving said saws to selected spaced positions therein.

6. The apparatus of claim 1, wherein said saws comprise carbide tipped circular saw blades and trueing devices for maintaining substantially true planer running of said blades during operation.

7. The apparatus of claim 1, wherein said conveyor moves a slab along said path at a speed no greater than 200 ft./min.

8. The apparatus of claim 1, wherein said upper planer head comprises a rotary knife planer.

9. The apparatus of claim 1, which further comprises slab hold-down mechanism mounted on set-works adjacent said planer heads which is raised and lowered in direct correlation to shifting of said upper planer head to maintain controlled movement of a slab along said conveyor path.

10. Lumber forming apparatus comprising an elongate frame having mounted thereon;

a conveyor for carrying a slab sawn from a log substantially horizontally along a path;

a lower rotating planer head positioned adjacent the underside of said path operable to remove a portion from the underside of such slab and provide a finished surface thereon;

an upper rotating planer head positioned above said path operable to remove a portion from the upper surface of such slab and provide a finished surface thereon;

setworks connected to and supporting said upper planer head operable to vary the vertical distance between said upper and lower planing heads;

a slab thickness sensor positioned upstream in said path from said upper head operable to sense the thickness of a slab entering said path as it is moved toward said upper planer head;

a controller operatively interconnecting said thickness sensor and setworks operable to move said upper head to a preselected vertical distance from said lower head in relation to the thickness of a slab directed [to]toward said upper head to produce a slab of preselected thickness; and a plurality of upright saws positioned downstream from said upper head to saw said slab into preselected board widths.

11. The apparatus of claim 10, wherein said lower planer head is preset in a selected position relative to the path of said conveyor.

12. The apparatus of claim 11, wherein said setworks is hydraulically actuated and said apparatus comprises a valve operable to control the flow of fluid under pressure to said setworks to position said upper planer head.

13. The apparatus of claim 12, wherein said controller is operable to produce shifting of said upper planer head to produce a slab of preselected finished thickness in relation to the thickness of the slab as sensed on entering the conveyor path upstream from said upper planer head.

14. The apparatus of claim 10, wherein said saws are mounted for shifting laterally within the conveyor path, and said apparatus comprises shifting mechanism for moving said saws to selected spaced positions therein.

15. The apparatus of claim 10, wherein said saws comprise carbide tipped circular saw blades and trueing devices for maintaining substantially true planar running of said blades during operation.

16. The apparatus of claim 10, wherein said conveyor moves a slab along said path at a speed no greater than 200 ft./min.

17. The apparatus of claim 10, wherein said upper planer head comprises a rotary knife planer.

18. A method for separating a plurality of slabs of varying thicknesses sawn from logs into a plurality of boards having smooth surfaced sides comprising the steps of moving such slabs sequentially and substantially horizontally along a path from an upstream region to a downstream region;

sensing the thickness of such a slab in a sensing area in the upstream region of the path;

providing upper and lower planing heads adjacent the top and bottom of said path downstream from said sensing area, said lower head being set to remove a minor portion of the underside of such slab to provide a finished surface thereon, and said upper head being shiftable vertically relative to said lower head;

positioning said upper head a selected vertical distance from said lower head in relation to the sensed thickness of such slab;

moving such slab in a downstream direction through the space between said planer heads to plane the slab to a selected thickness with smooth upper and lower surfaces;

providing multiple upright saws in the path of the slab downstream from said planer heads, said saws being spaced laterally apart desired distances for producing boards of selected widths; and moving said slab through said saws to produce boards with smooth sides.

19. The method of claim 18 wherein the slab is moved along said path at a speed no greater than 200 feet per minute.

20. The method of claim 18, wherein in said positioning step said upper head is positioned a selected vertical distance from said lower head which is substantially equal to a common thickness of board which is the maximum thickness that may be produced from said slab after removing at least a minimum thickness of material from the entire upper surface of such slab.

* * * * *